US006526697B1

(12) United States Patent
Borgardt

(10) Patent No.: US 6,526,697 B1
(45) Date of Patent: Mar. 4, 2003

(54) SWING DOOR PIVOT PROTECTOR

(76) Inventor: Ronald Borgardt, 2316 Tifton St., Kenner, LA (US) 70062

( * ) Notice: Subject to any disclaimer, the term of this patent is extended or adjusted under 35 U.S.C. 154(b) by 0 days.

(21) Appl. No.: 10/154,163

(22) Filed: May 23, 2002

Related U.S. Application Data

(60) Provisional application No. 60/294,101, filed on May 29, 2001.

(51) Int. Cl.[7] ..... E05B 1/00
(52) U.S. Cl. ..... 49/460
(58) Field of Search ..... 49/460, 462, 383; 16/85

(56) References Cited

U.S. PATENT DOCUMENTS 4,344,253 A * 8/1982 Stiles ..... 49/383
4,928,430 A * 5/1990 George ..... 49/460
5,799,443 A * 9/1998 Koeniguer ..... 49/383

* cited by examiner

*Primary Examiner*—Jerry Redman
(74) *Attorney, Agent, or Firm*—Garvey, Smith, Nehrbass & Doody, L.L.C.

(57) ABSTRACT

A protective frame positioned between the mounting of an automatic or manually swing door and the exterior, the frame comprising first and second upright members, a pair of absorbable members positioned between and mounted to the first and second upright members to be contacted by errant grocery carts, and deflecting the carts away from the door; and a spring-loaded mechanism for allowing one of the upright members to be rotated away from the door in the event the door is opened to the outside during an emergency, so that the door is able to travel a complete 90-degree path, without being impeded by the protective metal frame, and complying with fire and safety codes. When the door is closed, the absorbable members rotate back to the position to protect the door against carts.

13 Claims, 8 Drawing Sheets

SWING DOOR PIVOT PROTECTOR

CROSS-REFERENCE TO RELATED APPLICATIONS

Priority of U.S. Provisional Patent Application Serial No. 60/294,101, filed May 29, 2001, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to automatic door openers. More particularly the present invention relates to a protector positioned adjacent an automatic or a manually swinging door, such as a market, to protect the door mount from being struck by objects, such as grocery carts, yet allows the door to swing open to a 90 degree position in the event of an emergency.

2. General Background of the Invention

Automatic or manually swinging doors are very common in many settings. One such setting is the entry and exit from a grocery store. This type of door is very important since it allows people with baskets to approach the door, and the door open automatically, allowing the person to enter or exit the store. In most cases the door would automatically open into the store. However, the fire code and other safety codes require that in the event an emergency arises, that the door may be manually opened into the outside, to a point that the door will move from fully closed to a 90-degree position when set upon manually.

One of the problems incurred by groceries are errant grocery carts. Quite often a grocery cart will inadvertently strike the automatic door at its lower mounting pin upon which it rotates, and knock the door off of the pin, thus debilitating the door. One means devised to avoid this is to provide a metal frame between the door at the outside, so that a cart will strike the frame, not the door. However, when such frames are in place, the door is unable to meet fire and safety code standards, since it will be unable to open 90 degrees as required by code, but will be impeded by the safety frame. Therefore, fire marshals across the country are requiring that these frames be removed, and when done, the problem of errant grocery carts returns.

BRIEF SUMMARY OF THE INVENTION

The apparatus of the present invention solves the problems in the art in a simple and straightforward manner. What is provided is a protective frame positioned between the mounting of an automatic or manually swinging door and the exterior, the frame comprising first and second upright members, a pair of absorbable members positioned between and mounted to the first and second upright members to be contacted by grocery carts, and deflecting the carts away from the door; and a spring-loaded mechanism for allowing the absorbable members to be rotated away from the door in the event the door is opened to the outside during an emergency, so that the door is able to travel a complete 90-degree path, without being impeded by the protective metal frame, and complying with fire and safety codes. When the door is closed, the frame rotates back to the position to protect an automatic or manually swinging door against errant carts.

It is therefore a principal object of the present invention to provide an apparatus to protect an automatic or a manually swinging door from being struck by errant grocery carts;

It is a further object of the present invention to provide an apparatus which is mounted adjacent an automatic or manually swinging door, yet is able to rotate to a position away from the door when the door is opened to the exterior;

It is still a further object of the present invention to provide an apparatus which in a first position protects automatic or manually swinging doors against grocery cart damage, and in a second position allows the automatic door to open to the required 90-degrees to the exterior to comply with fire and safety codes.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
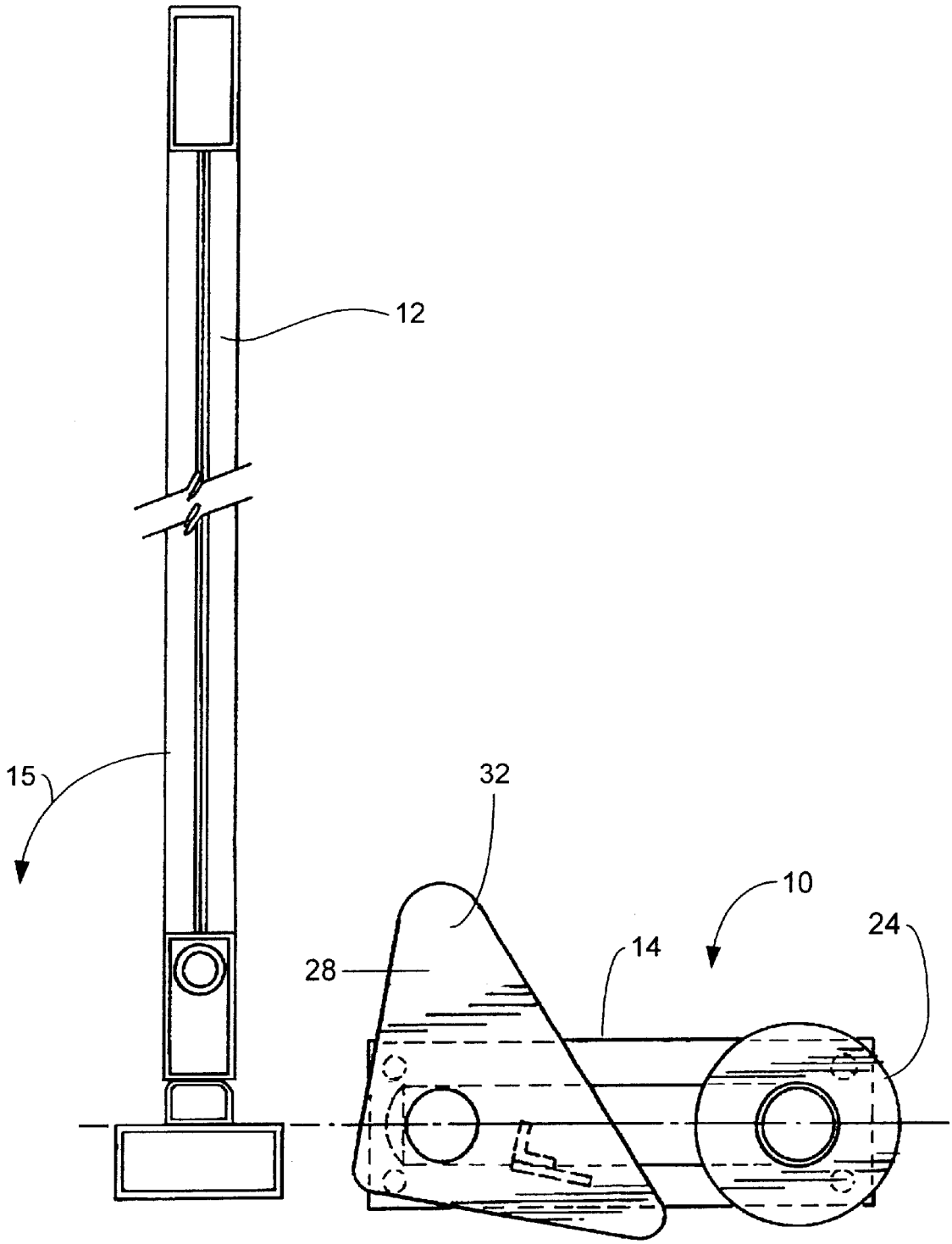
FIG. 1 is an overall top view of the apparatus of the present invention illustrating a swinging door in the closed position.

The apparatus of the present invention is illustrated by the numeral 10 in FIGS. 1–7. As illustrated first in top view in FIGS. 1 and 2, apparatus 10 is mounted adjacent a swinging door 12 such as the type that would be found in various commercial outlets such as supermarkets or the like which would normally open automatically or manually to the interior of the store. As seen in FIG. 1, door 12 would be mounted on a rotating shaft 13 and a frame 19 so as to allow door 12 to pivot between open and closed positions, and to the breakaway position as will be described further.

Figure 2:
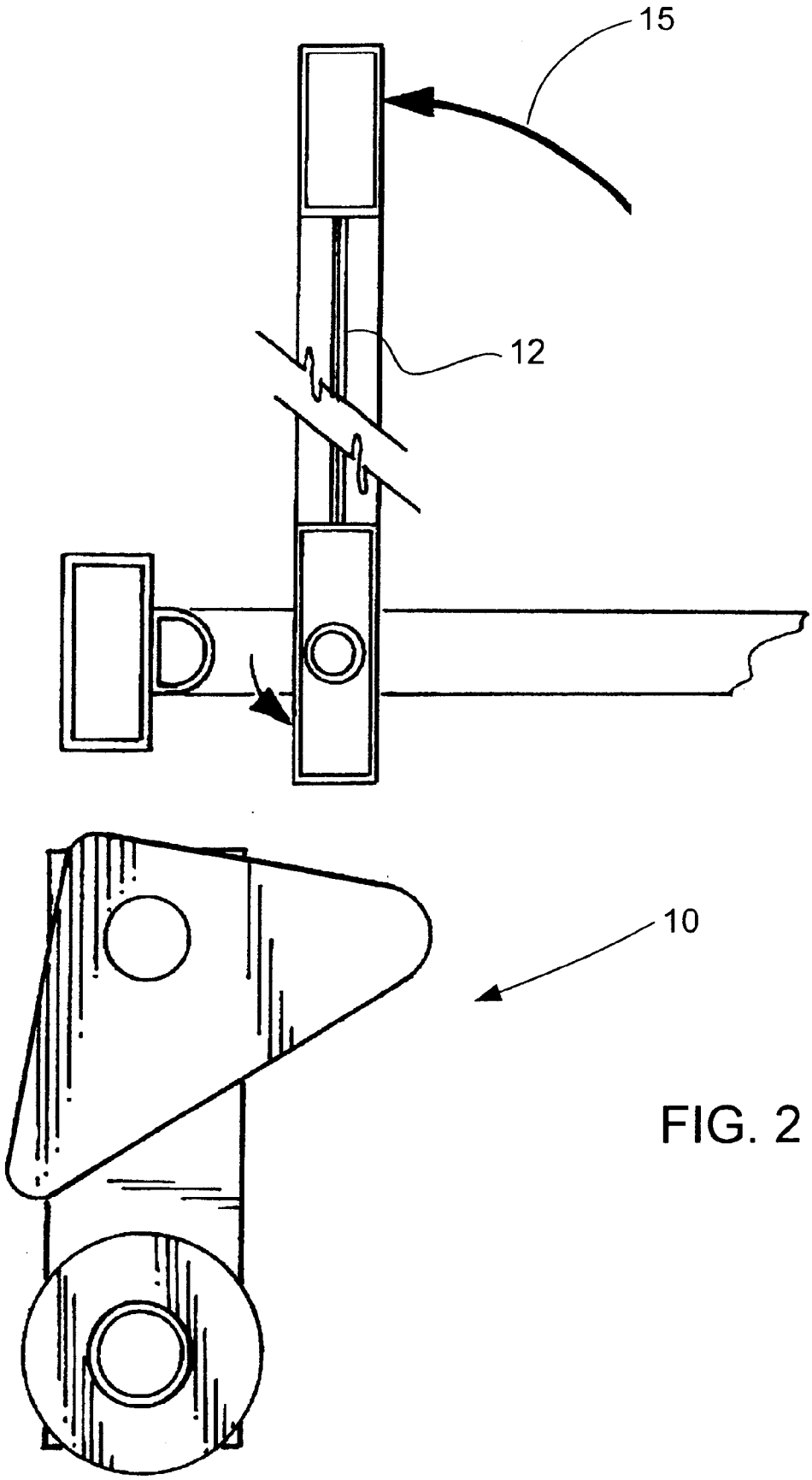
FIG. 2 is an overall top view of the apparatus of the present invention illustrating a swinging door moving from the closed to the open position.
Figure 3:
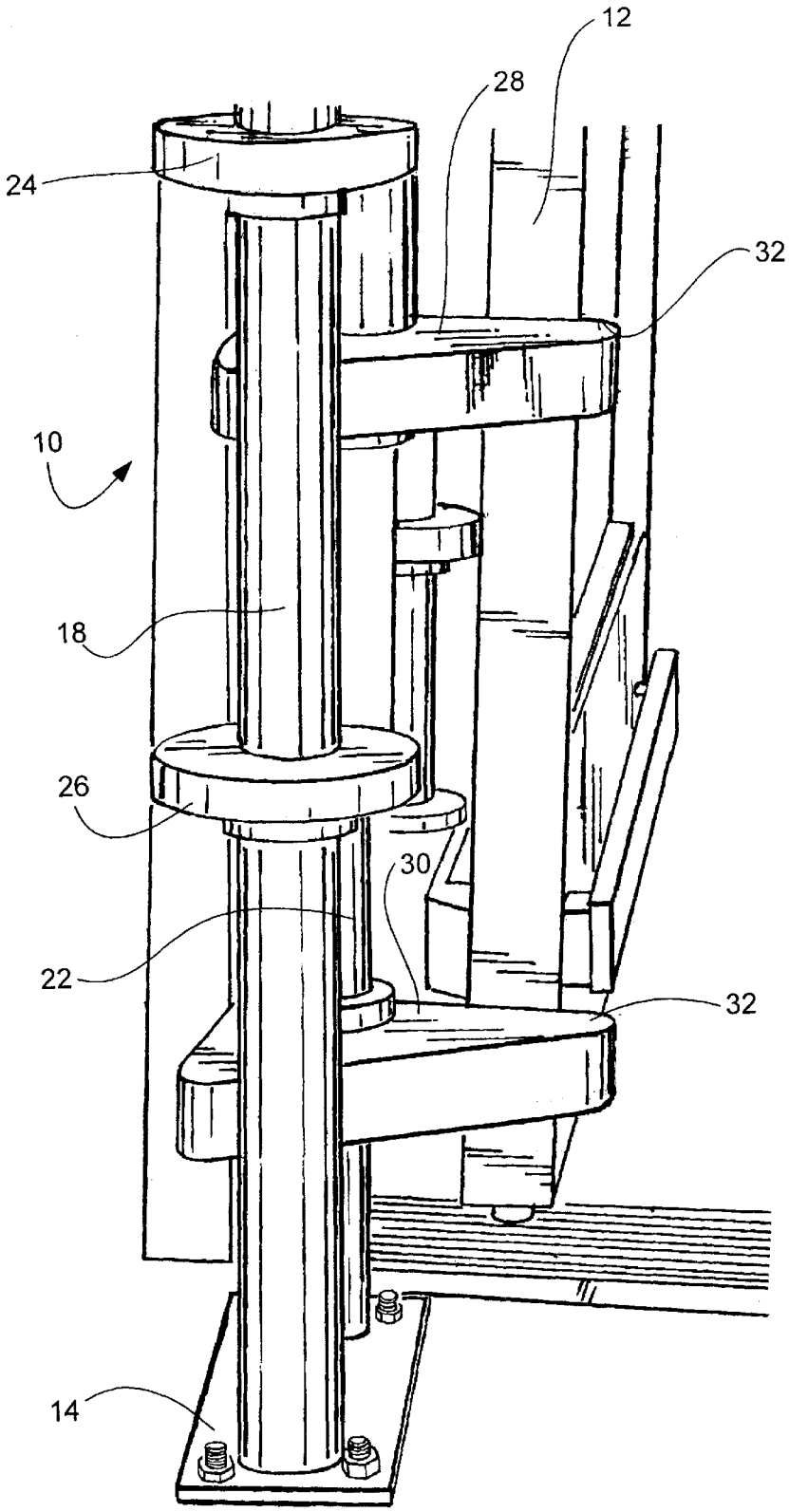
FIG. 3 is an overall view of the apparatus with a swinging door having swung to the open position.
Figure 6:
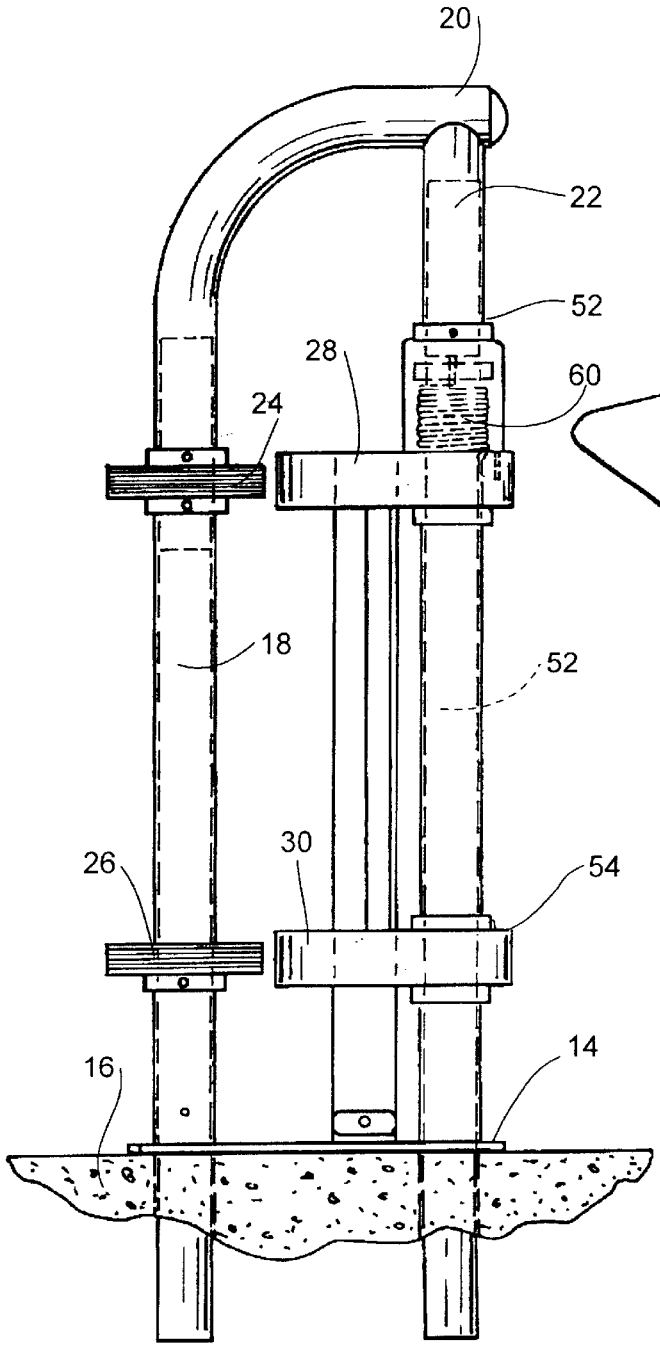
FIG. 6 illustrates a side view of the rotatable members in the position after the door has swung into the breakaway position.

Apparatus 10 would be mounted adjacent the exterior of door 12 as illustrated. There would be first included a mounting floor plate 14 which would be secured to the concrete surface or the like 16 via bolting or the like. This mounting can also be seen in FIG. 6. As seen in FIG. 6, there would be a first upright vertical member 18, the vertical member 18 terminating in an upper portion 20 which would be secured to a second upright member 22 which would likewise extend through the floor plate 14 and into the base below the floor plate 13 be secured thereto. It should be noted that the first upright member 18 has a pair of circular bumper members 24, 26 which are spaced along its length. The functioning of the bumper members would be such that should a runaway basket of the type found at supermarkets should make contact with upright member 20, the bumper members 24, 26 would deflect this contact away from the upright member and away from the door. The second upright member 22 would likewise include a pair of triangulated heavy duty bumper members 28 and 30. Again, bumper members 28 and 30 are spaced apart along the length of upright member 22, and terminate in a long triangulated point 32. As seen in FIGS. 1 through 3, when the door is in the normal closed position or the normal open position, i.e. opening to the interior of the store as seen in FIG. 2, the bumper members 28, 30 remain stationary.

Figure 4A:
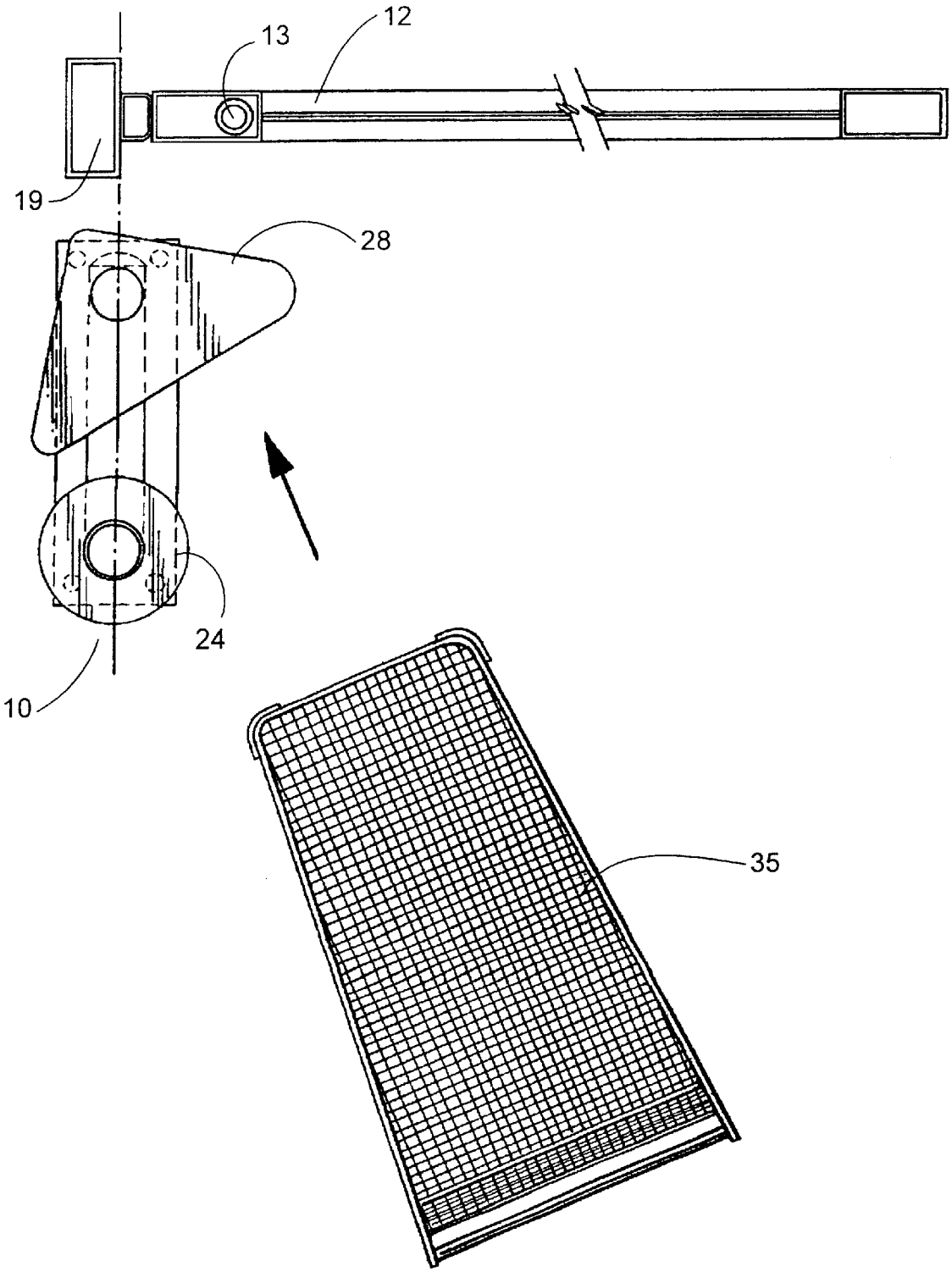
FIGS. 4A through 4E illustrate sequential views of a runaway grocery cart making contact with the apparatus of the present invention.
Figure 4B:
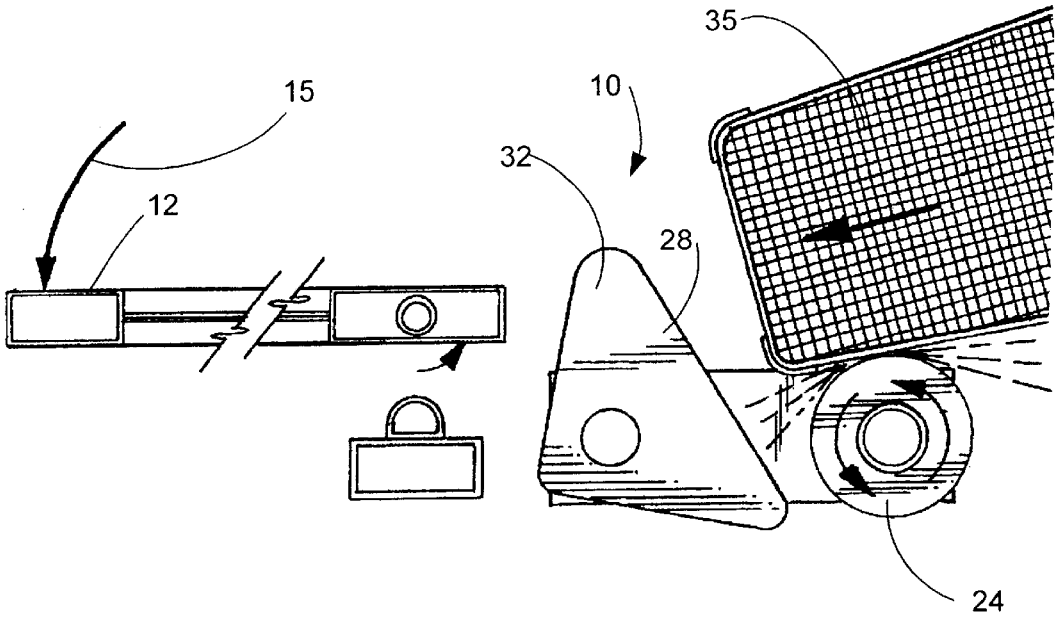
Figure 4C:
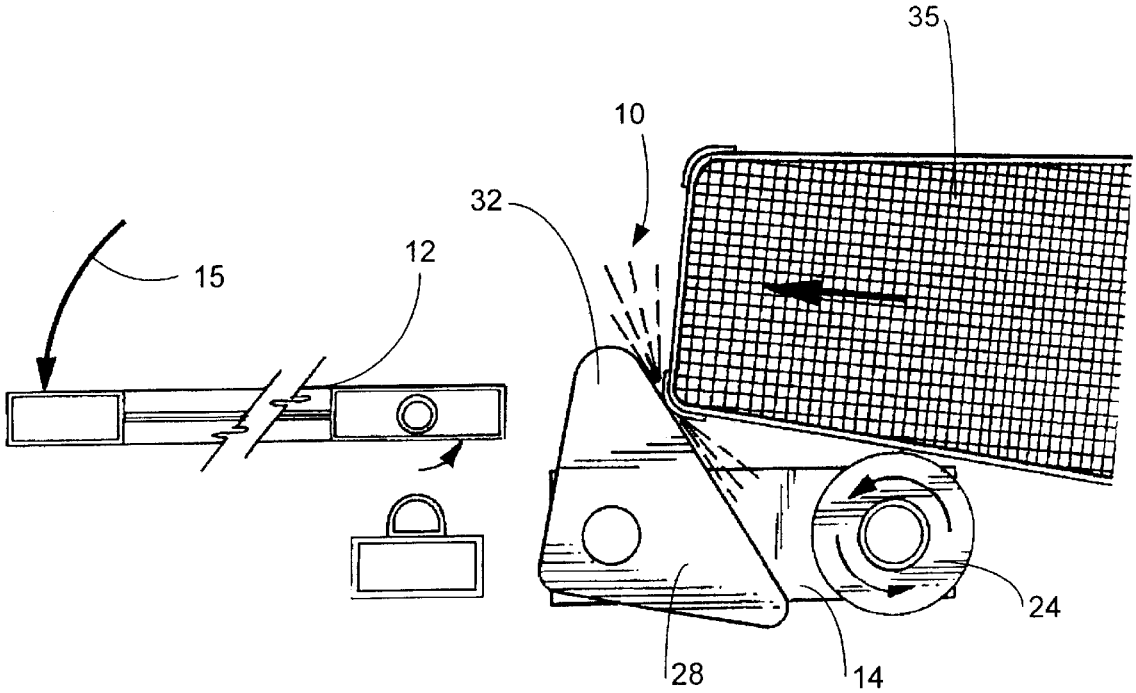
Figure 4D:
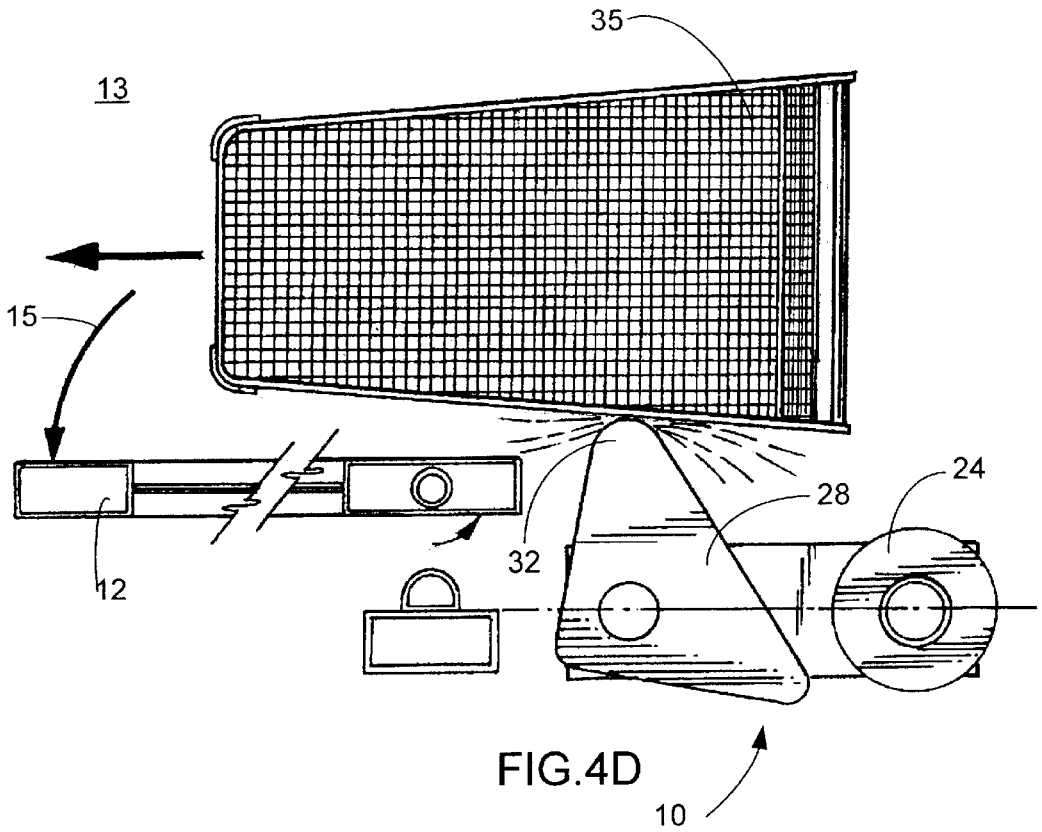
Figure 4E:
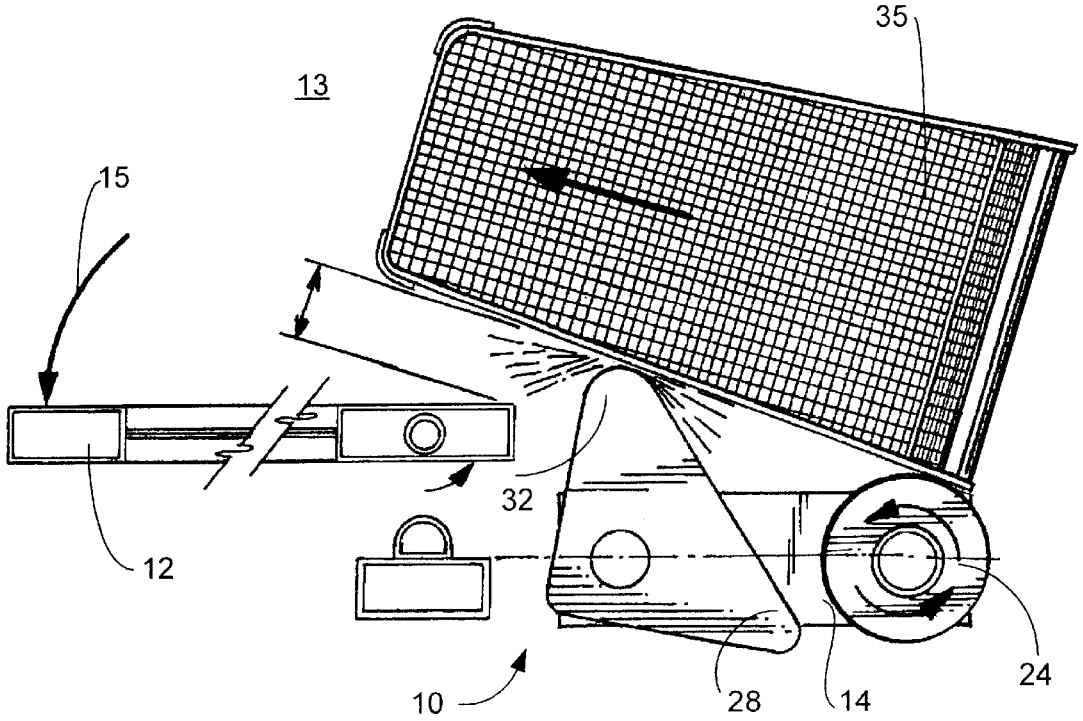

Reference is made to FIGS. 4A through 4E, where there is illustrated in sequence the protection offered by the circular bumper members 24, 26, and the second set of bumper members 28, 30. As illustrated in FIG. 4A, a runaway or discarded basket 35 is moving toward the closed door 12 of the building; in FIG. 4B, the basket 35 has encountered a circular bumper members 24, 26, and is deflected toward the second bumper members 28, 30 and makes contact with them at triangulated portion 32 as seen in FIG. 4C. Because of the triangulated portion 32, extending past the mounting base 19 of door 12, the basket is deflected away from the door mount. Since the door 12 has opened automatically, sensing a basket coming through, the basket, as seen in FIG. 4E, moves into and through the door opening space 13, rather than making contact with the door or its mounting frame. Therefore, as seen in FIGS. 4A through 4E, when the door 12 is either in the normal closed or in the open position, bumper members 28 and 30 remain stationary and do not move at all during the operation, carrying out their protective functions.

Figure 5:
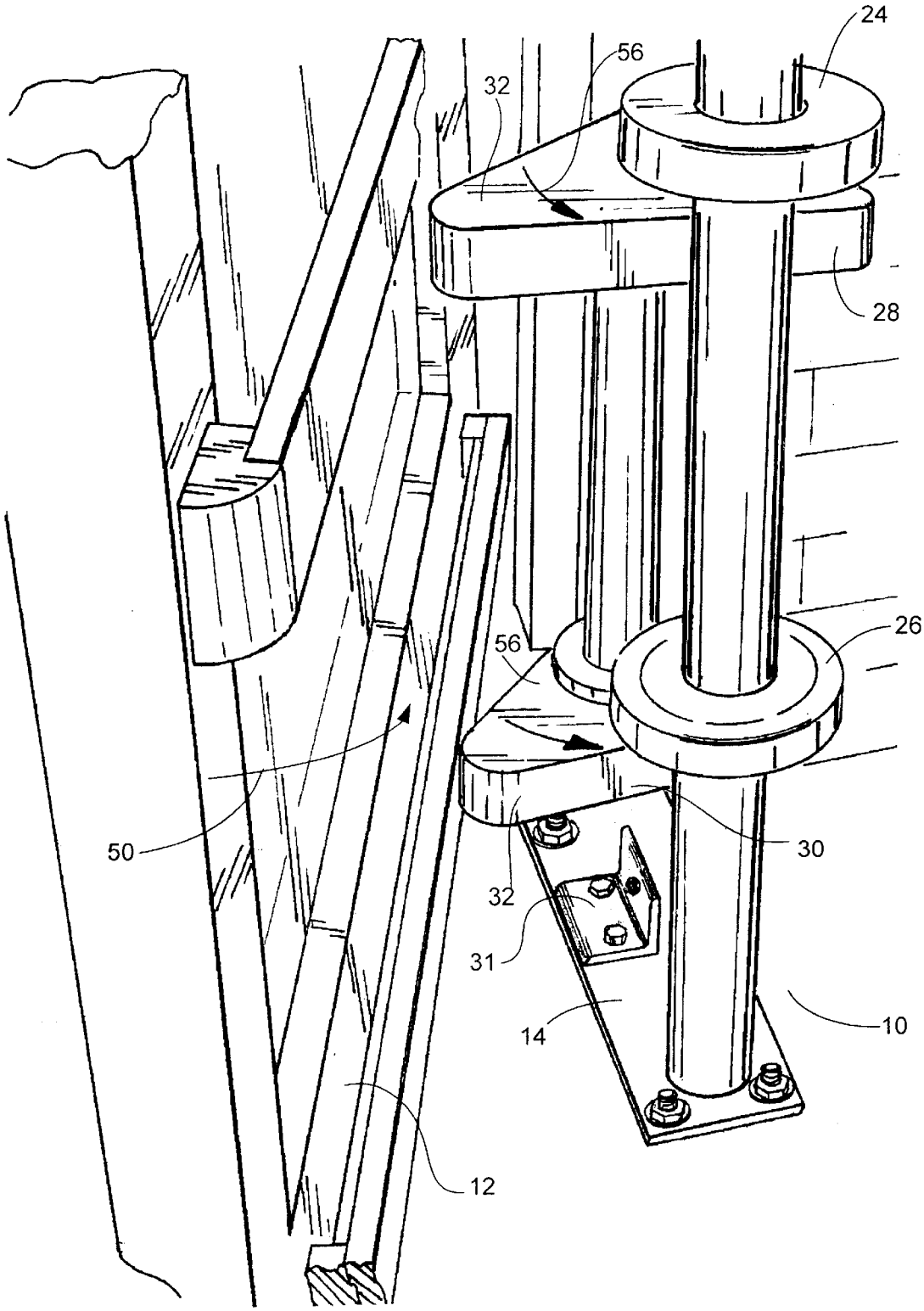
FIG. 5 an overall view of the present invention as the swinging door is moving to the breakaway position.
Figure 7:
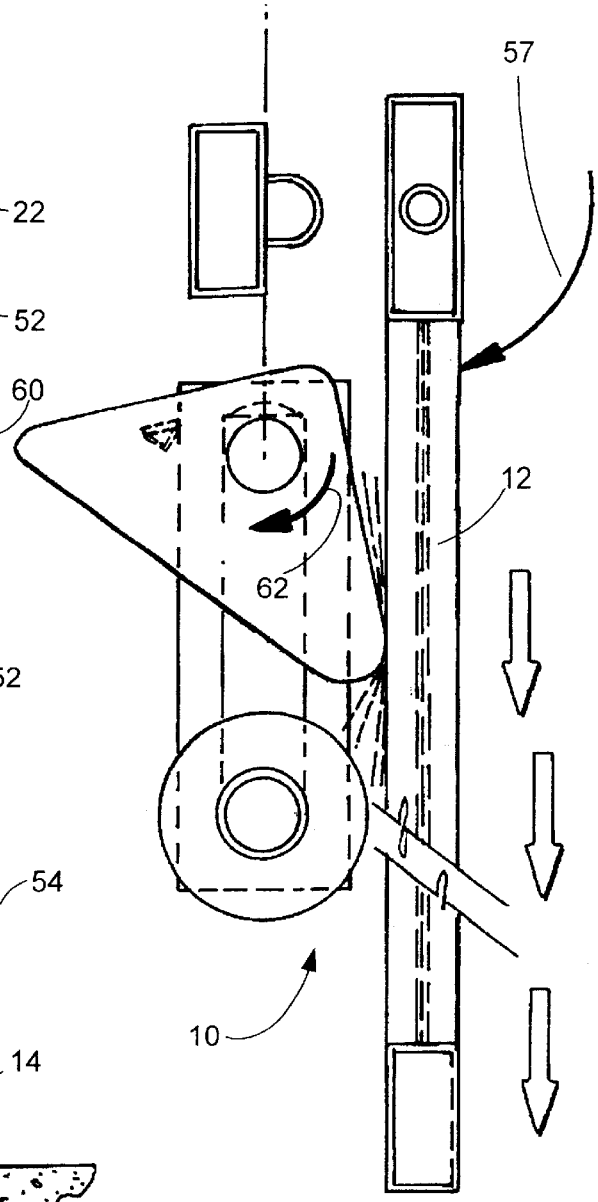
FIG. 7 illustrates a top view of the door in the full breakaway position, and the rotatable members rotating to accommodate the breakaway position of the door.

Reference is now made to FIGS. 5 through 7 where there is illustrated the operation of the apparatus when the swinging door 12 must be moved to the open position, i.e. the breakaway position in an emergency. During an emergency, a swinging door must always open to the exterior as opposed to the normal functioning where the door would open to the interior of the store. Therefore, turning first to FIG. 5, when the breakaway door 12 is swinging in the direction of arrow 50 into the open position towards the breakaway position, bumpers 28 and 30 would normally prevent the door from opening since, as seen in FIGS. 1 through 4E, the bumpers 28, 30 are protruding outward in the path of the opening door 12. However, bumper members 28, 30 are rotatably mounted onto second upright member 22 and are supported by a pair of shafts 52, 54 (seen in FIG. 6) which maintain the stability of the bumper members during the operation. Therefore, as the door 12 moves to the open breakaway position as seen in FIG. 3, when contact is made with the bumpers 28, 30, the bumpers 28, 30 rotate away from the door in the direction of arrow 56 and therefore allow the door 12 to swing open to the full 90 degree breakaway position as seen in FIG. 4. When this occurs, one is able to use the doorway in an emergency fashion. FIG. 5 also illustrates adjustable stop member 31 which prevents the door from opening further than 90 degrees when it makes contact with adjustable stop member 31.

When the door is placed back to its normal operating position as seen in FIGS. 1 and 2, there is illustrated in FIG. 6, a spring 60 mounted onto shaft 52 would serve to automatically move the bumpers 28, 30 back to their normal protective position as seen in FIGS. 1 through 4E. As illustrated in FIG. 7, the door has moved completely into its breakaway position, as seen by arrow 57, i.e., 90 degrees from the closed position, and extending to the exterior, with the bumpers 28, 30 having rotated in the direction of arrow 62 in order to accommodate the breakaway door position. This rotation of the bumpers 28, 30 would occur each time the door 12 has to be rotated to the breakaway position. Once the emergency has passed, the door would be repositioned in its closed position, and the spring 60 would rotate the bumpers 28, 30 back to their guard position as described in relation to FIGS. 1 through 4E.

It should be noted that the mechanism as described may have additional bumpers, both circular or triangular shaped, with the key being that the bumpers 28, 30 carry out an important guard function to protect the door and its mount during normal operation, yet serve a second important function of having the ability to rotate against the movement of the door as it would move to the breakaway position during an emergency.

The foregoing embodiments are presented by way of example only; the scope of the present invention is to be limited only by the following claims.

What is claimed is:

1. An apparatus for protecting automatic doors against damage from being struck by an item, such as a grocery cart, comprising:

a) a protective frame having at least two upright members positioned exterior and adjacent a mounted edge of an automatic door;

b) at least one absorbable member mounted to each of and between the upright members to deflect the item from the automatic door as the item strikes the absorbable member;

c) means for rotating at least one of the upright members from a first position for deflecting items from contacting the automatic door, to a second position for allowing the automatic door to swing to the outside sufficiently to allow the automatic door to move fully to a breakaway position.

2. The apparatus in claim 1, wherein the automatic door is a door of a type which opens into a building under normal operating conditions.

3. The apparatus in claim 1, wherein one of the upright members is mounted stationary and a second member pivots between its first and second positions.

4. The apparatus in claim 3, wherein there is further provided absorbable members on the stationary upright member.

5. The apparatus in claim 1, wherein there is provided two absorbable members mounted between the upright members.

6. The apparatus in claim 1, wherein the upright member which rotates when in the second position allows the automatic door to open into the outside to a 90-degree position from a closed position.

7. An apparatus for protecting automatic doors of a type used in grocery stores against damage from being struck by an errant grocery cart, comprising:

a) a protective frame having at least two upright members positioned exterior and adjacent a mounted edge of an automatic door, at least one of the upright members pivotable between first and second positions;

b) at least two spaced apart absorbable members mounted to at least the upright member which pivots, in a first position, to receive impact from the errant grocery cart as the grocery cart strikes the absorbable members and deflects the grocery cart away from an automatic door mount; and c) in a second position, moveable for allowing the automatic door to swing to outside at least 90 degrees from a closed position during an emergency.

8. The apparatus in claim 7, wherein one of the two upright members remains stationary at all times.

9. The apparatus in claim 8, further comprising at least two stationary absorbable members positioned on the stationary upright member for receiving impact of the grocery cart before impact is received by the absorbable members on the upright member which pivots.

10. An apparatus for protecting doors of a type used in grocery stores against damage from being struck by an errant grocery cart, comprising:

a) a protective frame having at least two upright members positioned exterior and adjacent a mounted edge of a door, at least one of the upright members pivotable between first and second positions;

b) at least two spaced apart absorbable members mounted to at least the upright member which pivots, in a first position, for receiving impact from the errant grocery cart as the grocery cart strikes the absorbable members and deflecting the grocery cart away from a door mount; and c) moveable to a second position, for allowing the door to swing to outside sufficient to be in a breakaway position from a closed position as required during an emergency.

11. The apparatus in claim 10, wherein the breakaway position is 90 degrees to exterior from a closed position of a door.

12. The apparatus in claim 10, wherein one of the upright members is stationary and further comprises at least two circular bumpers which absorb impact of the grocery cart before the grocery cart makes contact with the absorbable members on the upright member which pivots.

13. The apparatus in claim 10, further comprising a spring member mounted on the member which pivots which allows the absorbable members on the member which pivots to automatically return to the first position after a door has returned to normal operation from the breakaway position.

* * * * *